US009030115B2

(12) United States Patent
Johnson

(10) Patent No.: US 9,030,115 B2
(45) Date of Patent: May 12, 2015

(54) LED DRIVER WITH DIAC-BASED SWITCH CONTROL AND DIMMABLE LED DRIVER

(71) Applicant: ABL IP Holding LLC, Conyers, GA (US)

(72) Inventor: James Clarence Johnson, Conyers, GA (US)

(73) Assignee: ABL IP Holding LLC, Conyers, GA (US)

( * ) Notice: Subject to any disclaimer, the term of this patent is extended or adjusted under 35 U.S.C. 154(b) by 279 days.

(21) Appl. No.: 13/827,532

(22) Filed: Mar. 14, 2013

(65) Prior Publication Data

US 2013/0342126 A1 Dec. 26, 2013

Related U.S. Application Data

(60) Provisional application No. 61/663,136, filed on Jun. 22, 2012.

(51) Int. Cl.

| | |
|---|---|
| ***H05B 37/02*** | (2006.01) |
| ***H05B 39/04*** | (2006.01) |
| ***H05B 41/36*** | (2006.01) |
| ***H05B 33/08*** | (2006.01) |

(52) U.S. Cl.
CPC ..... *H05B 33/0815* (2013.01)

(58) Field of Classification Search
USPC ..... 315/223, 224, 291
See application file for complete search history.

(56) References Cited

U.S. PATENT DOCUMENTS

| | | | | |
|---|---|---|---|---|
| 5,293,099 | A * | 3/1994 | Bobel | 315/225 |
| 5,463,280 | A | 10/1995 | Johnson | |
| 5,739,639 | A | 4/1998 | Johnson | |
| 6,282,105 | B1 * | 8/2001 | Boudan et al. | 363/37 |
| 8,129,914 | B2 | 3/2012 | Zimmermann | |
| 8,829,812 | B2 * | 9/2014 | Veltman | 315/307 |
| 2010/0090618 | A1 * | 4/2010 | Veltman | 315/307 |
| 2010/0259196 | A1 * | 10/2010 | Sadwick et al. | 315/309 |
| 2011/0115391 | A1 * | 5/2011 | Chao et al. | 315/224 |
| 2011/0193494 | A1 * | 8/2011 | Gaknoki et al. | 315/297 |
| 2011/0194312 | A1 * | 8/2011 | Gaknoki et al. | 363/21.12 |
| 2012/0026761 | A1 * | 2/2012 | Young | 363/44 |
| 2012/0056548 | A1 * | 3/2012 | Duan et al. | 315/200 R |
| 2013/0057167 | A1 * | 3/2013 | Angeles | 315/200 R |
| 2013/0342126 | A1 * | 12/2013 | Johnson | 315/224 |
| 2014/0009082 | A1 * | 1/2014 | King et al. | 315/247 |
| 2014/0028214 | A1 * | 1/2014 | Mazumdar et al. | 315/279 |
| 2014/0167652 | A1 * | 6/2014 | King et al. | 315/307 |
| 2014/0197741 | A1 * | 7/2014 | Sakai et al. | 315/123 |
| 2014/0214362 | A1 * | 7/2014 | Chen et al. | 702/176 |
| 2014/0265836 | A1 * | 9/2014 | Nourbakhsh et al. | 315/71 |
| 2014/0265859 | A1 * | 9/2014 | Lewis | 315/121 |
| 2014/0361699 | A1 * | 12/2014 | Sullivan | 315/200 R |
| 2014/0375216 | A1 * | 12/2014 | Seidmann | 315/149 |
| 2014/0375223 | A1 * | 12/2014 | Tao et al. | 315/186 |
| 2015/0035442 | A1 * | 2/2015 | Mikani et al. | 315/185 R |
| 2015/0035450 | A1 * | 2/2015 | Werner | 315/291 |

* cited by examiner

*Primary Examiner* — Adam Houston

(74) *Attorney, Agent, or Firm* — Kilpatrick Townsend & Stockton, LLP

(57) ABSTRACT

An LED driver may use a DIAC oscillator circuit to controls a semiconductor switch in a switching circuit. The DIAC oscillator circuit uses rectified line power and so it does not require a separate power source. An LED driver may uses a zero crossing circuit to provide low level dimming. The zero crossing circuit includes a linear circuit or a constant current circuit that keeps a TRIAC dimmer on and stable during low current levels.

21 Claims, 7 Drawing Sheets

LED DRIVER WITH DIAC-BASED SWITCH CONTROL AND DIMMABLE LED DRIVER

RELATED APPLICATION

This application claims priority to U.S. Application No. 61/663,136 filed Jun. 22, 2012 for DIAC Based LED Driver Circuit, which is incorporated herein by reference.

FIELD OF THE INVENTION

The present invention is related to LED drivers and more particularly to controlling a switching circuit with a DIAC oscillator and to providing a linear or constant current operating mode to support a TRIAC dimmer.

BACKGROUND

Conventional LED (light emitting diode) driver designs often include switching circuits that require a timing device to control a semiconductor switch. An integrated circuit typically acts as the timing device. The integrated circuit requires its own power source and usually requires additional components for interfacing the power source to the integrated circuit. The integrated circuit may be a key component of the cost of an LED driver since the integrated circuit is itself relatively costly and the power source and the other components needed to support the integrated circuit add additional cost. As the use of LEDs in lighting applications expands, there is a need to provide LED driver designs that are low cost and that can be included in applications with limited space.

Many lighting applications require dimming. Conventional dimmers include TRIAC dimmers. One issue with using a TRIAC dimmer with an LED array is that at low current levels, the TRAIC dimmer may become unstable and may cause flicker. To address this issue a TRAIC dimmer may be connected to multiple LED arrays to provide a minimum load. However, this limits the available dimming level. In order to support low levels of dimming with an LED array, there is a need to operate a TRIAC dimmer at low current levels without requiring connection to multiple LED arrays.

SUMMARY

Aspects of the invention include an LED driver that uses a DIAC oscillator circuit to control a semiconductor switch. The DIAC oscillator circuit may be connected to rectified line power so it does not require its own power source. Using a DIAC oscillator circuit in an LED driver reduces the cost of the driver and the space needed for the driver since it eliminates the need for an integrated circuit and a separate power source. An LED driver that uses a DIAC oscillator circuit is well-suited for space limited applications, such as those having a driver on the light engine board.

In addition, an LED driver that uses a DIAC oscillator circuit may be faster than a driver that uses an integrated circuit. The start-up delay that is associated with having a separate power source and an integrated circuit is eliminated since the DIAC begins to conduct as soon as it sees its breakover voltage.

Other aspects of the invention provide a zero crossing circuit that supports low dimming levels with a TRIAC dimmer. The zero crossing circuit may be used in combination with a timing control circuit, such as a DIAC oscillator, and a switching circuit, such as a buck circuit. Alternatively, the zero crossing circuit may be used with other types of timing control circuits and switching circuits. The zero crossing circuit may include a linear circuit or a constant current circuit to keep the TRIAC dimmer on at low current levels.

Other features, advantages, and objects of the present invention will be apparent to those skilled in the art with reference to the remaining text and drawings of this application.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

An LED driver that uses a DIAC oscillator circuit provides a simple, cost-effective LED driver design. The DIAC oscillator circuit controls a semiconductor switch in a switching circuit. The DIAC oscillator circuit uses rectified line power so it does not require a separate power source. An LED driver that uses a zero crossing circuit provides low level dimming. The zero crossing circuit includes a linear circuit or a constant current circuit that keeps a TRIAC dimmer on and stable during low current levels. The zero crossing circuit can be used in an LED driver regardless of whether the LED driver uses a DIAC oscillator circuit.

DIAC Oscillator Circuit

Figure 1:
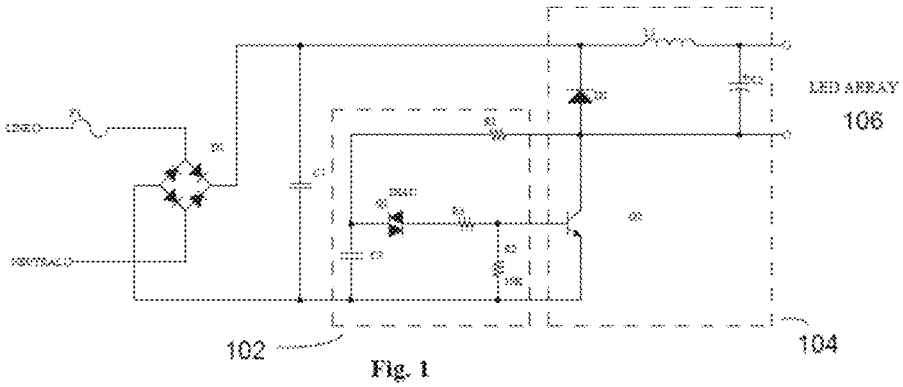
FIG. 1 is a circuit diagram illustrating an LED driver with an exemplary DIAC oscillator circuit.

FIG. 1 illustrates an exemplary driver circuit design that includes a DIAC oscillator circuit 102 and a buck circuit 104, which drives an LED array 106. Rectified line power is provided to the DIAC oscillator and the buck circuit. The DIAC oscillator circuit includes a DIAC device Q1, a charging resistor R1, a capacitor C3, and a load resistor R2, as well as an optional discharge resistor R3. The buck circuit includes an inductor L1, a diode D2, a transistor or semiconductor switch Q2, and a capacitor C2. Note that capacitor C2 is optional. In a typical buck circuit capacitor C2 is an electrolytic capacitor. If capacitor C2 is not used, then the driver circuit design may be implemented without an electrolytic capacitor. Since the DIAC begins to conduct as soon as it sees its breakover voltage it provides less delay than an integrated circuit with an external power source. This increase in speed results in lower energy storage requirements so that it may be possible to eliminate electrolytic capacitors from the LED driver. Since the anticipated operating life of an electrolytic capacitor may be less than the other components in an LED driver, eliminating electrolytic capacitors improves the anticipated operating life of the LED driver.

The charging resistor R1 of the DIAC oscillator circuit is connected to the collector of the transistor Q2 of the buck circuit, the anode of the diode D2, and the LED array at one terminal and is connected to the DIAC Q1 and the capacitor C3 at its other terminal. One terminal of the discharge resistor R3 of the DIAC oscillator circuit is connected to the base of the transistor Q2 of the buck circuit and the load resistor R2 and the other terminal is connected to the DIAC Q1. The capacitor C3 is connected to the charging resistor R1 and the DIAC at one terminal and is connected to the emitter of transistor Q2 and to the load resistor R2 at its other terminal. When the DIAC is conducting, the DIAC oscillator circuit turns transistor Q2 on and when the DIAC is not conducting, the DIAC oscillator circuit turns transistor Q2 off.

The DIAC Q1 does not conduct until it sees its breakover voltage, which is typically in the range of 30-32 volts. When the DIAC is not conducting, the transistor Q2 is off and capacitor C3 is charging. Capacitor C3 is charged by the current flowing through inductor L1, the LED array and charging resistor R1. Once the DIAC sees its breakover voltage, then the DIAC conducts and turns transistor Q2 on. While the DIAC is conducting the capacitor C3 is discharging. When transistor Q2 is on, the current through L1 drives the LED array. When the capacitor C3 discharges to the point that it no longer provides sufficient current, the DIAC stops conducting and the DIAC oscillator circuit turns transistor Q2 off. When transistor Q2 is off, the energy stored in inductor L1 drives the LED array. The process of the DIAC not conducting and conducting and in response turning transistor Q2 off and on repeats itself until the voltage falls below the DIAC breakover voltage.

Figure 2:
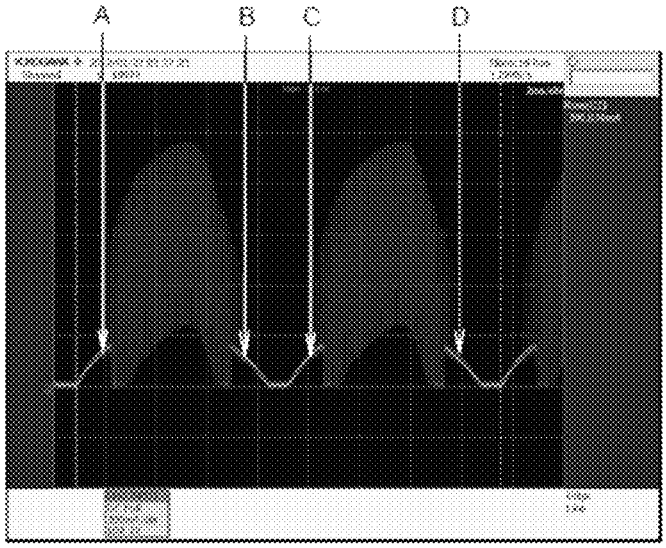
FIG. 2 is a waveform illustrating switched operation and linear operation for an exemplary LED driver.

FIG. 2 illustrates the rectified signal that feeds the DIAC oscillator circuit. Point A represents the approximate point where the DIAC first sees its breakover voltage and Point B represents the approximate point where the DIAC no longer sees its breakover voltage. Between points A and B, the DIAC oscillator circuit operates to control transistor Q2. This is referred to herein as DIAC switched operation. It may also be referred to as switched operation to include LED drivers that use any type of timing circuit.

Figure 3:
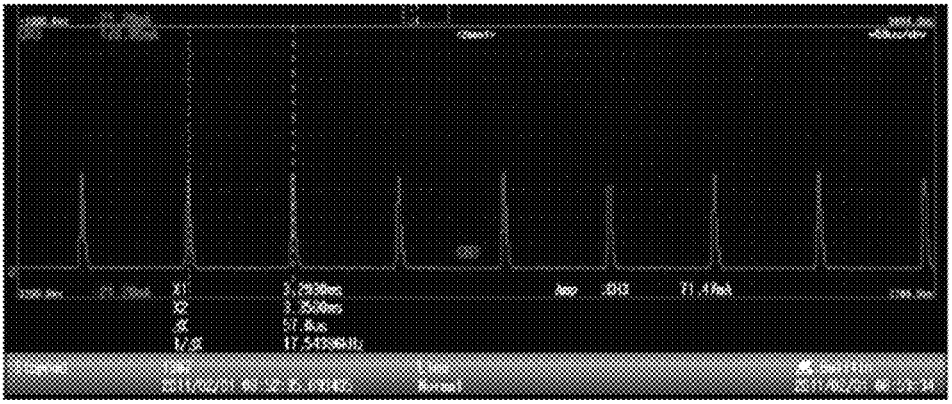
FIG. 3 is a waveform illustrating an output of a DIAC oscillator circuit.
Figure 4:
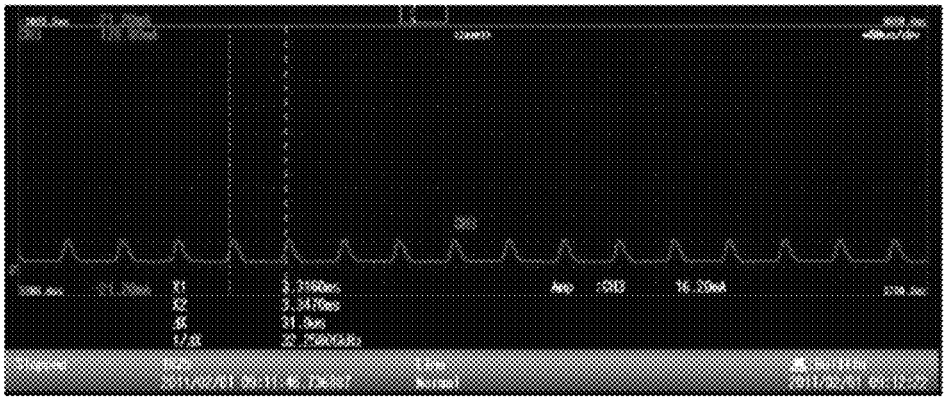
FIG. 4 is a waveform illustrating an output of another DIAC oscillator circuit.

The operation of the DIAC oscillator circuit is further illustrated by the waveforms in FIGS. 3 and 4. The waveforms illustrate the current and the frequency of oscillation provided by the DIAC oscillator circuit for different values of the discharge resistor R3. As the value of the discharge resistor R3 increases, the current pulses become lower and wider. For example, FIG. 3 illustrates that when R3=1 ohm, the transistor Q2 is controlled by higher narrower pulses and in FIG. 4 when R3=200 ohm, the transistor Q2 is controlled by lower wider pulses. The waveforms illustrate an exemplary range of duty cycles that can be used to switch transistor Q2.

The values for the other components in the DIAC circuit shown in FIG. 1 are typically selected based on the power requirements of the LED array and the buck circuit. Exemplary values for one implementation are as follows: R1=43K ohms, C3=0.01 uF, R2=10K ohms.

Figure 5:
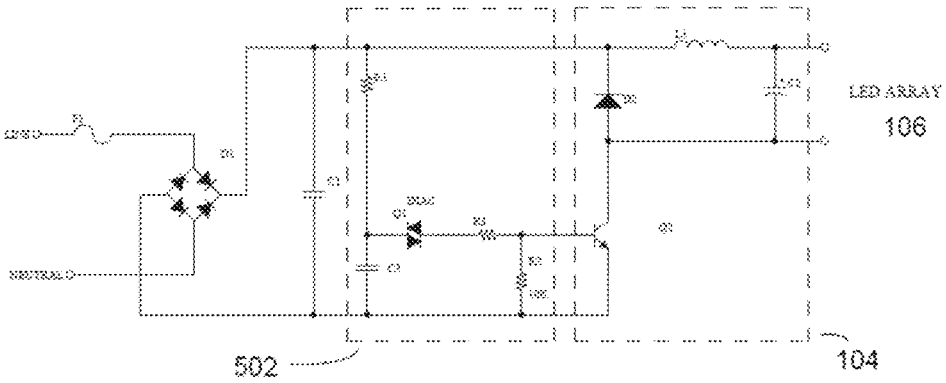
FIG. 5 is a circuit diagram illustrating an LED driver with another exemplary DIAC oscillator circuit.

An alternative DIAC oscillator circuit design is illustrated in FIG. 5. This design is similar to the circuit illustrated in FIG. 1 except that the charging resistor R1 of the DIAC oscillator circuit 502 is connected to the buck circuit 104 so that one terminal is connected to the cathode of diode D2 and the inductor L1. In this circuit, capacitor C3 is charged by the current flowing through charging resistor R1. Once the DIAC sees its breakover voltage, then the DIAC conducts and turns transistor Q2 on. While the DIAC is conducting the capacitor C3 is discharging. When transistor Q2 is on, the current through L1 drives the LED array. When the capacitor C3 discharges to the point that it no longer provides sufficient current, the DIAC stops conducting and the DIAC oscillator circuit turns transistor Q2 off. When transistor Q2 is off, the energy stored in inductor L1 drives the LED array. The process of the DIAC not conducting and conducting and in response turning transistor Q2 off and on repeats itself until the voltage falls below the DIAC breakover voltage. Exemplary values for one implementation of the DIAC oscillator circuit shown in FIG. 5 are as follows: R1=43K ohms, C3=0.01 uF, R2=10K ohms.

Turn off Circuit

Figure 6:
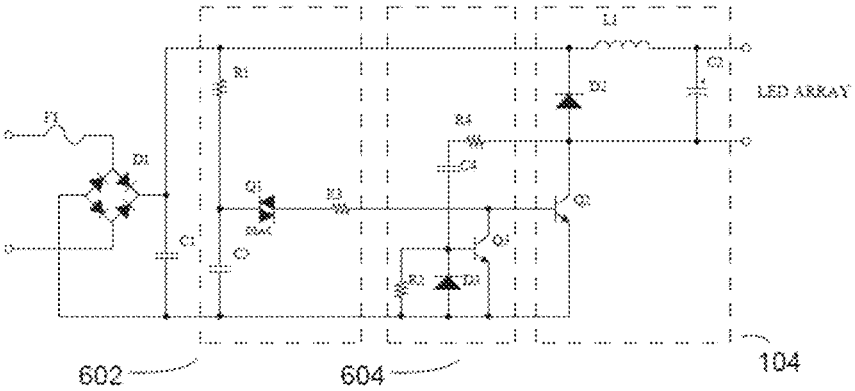
FIG. 6 is a circuit diagram illustrating an LED driver with an exemplary turn off circuit.

The DIAC oscillator circuit may be combined with another circuit to increase the turn off speed of transistor Q2 in order to minimize loss. An example of this "turn off" circuit is illustrated by FIG. 6. FIG. 6 illustrates the turn off circuit 604 combined with the DIAC oscillator circuit 602 and buck circuit 104 of FIG. 5. The turn off circuit 604 includes a transistor Q3, a diode D3, a capacitor C4 and a resistor R4. The resistor R4 is connected to the anode of diode D2 and to the LED array at one terminal and is connected to capacitor C4 at its other terminal. Capacitor C4 is connected to resistor R4 at one terminal and to the base of transistor Q3 and the cathode of diode D3 at its other terminal. The collector of transistor Q3 is connected to the base of transistor Q2, the base of transistor Q3 is connected to capacitor C4 and to the cathode of diode D3, and the emitter of transistor Q3 is connected to the emitter of transistor Q2 and to the anode of diode D3.

The turn off circuit operates so that when transistor Q2 starts to turn off, current flows through resistor R4 and capacitor C4 and turns on transistor Q3, which then clamps the base-emitter junction of transistor Q2 to quickly turn transistor Q2 off. Although FIG. 6 illustrates the turn off circuit with the DIAC oscillator circuit of FIG. 5, the turn off circuit can also be used with the DIAC oscillator circuit of FIG. 1 or other DIAC oscillator circuits.

Zero Crossing Circuit

Figure 7:
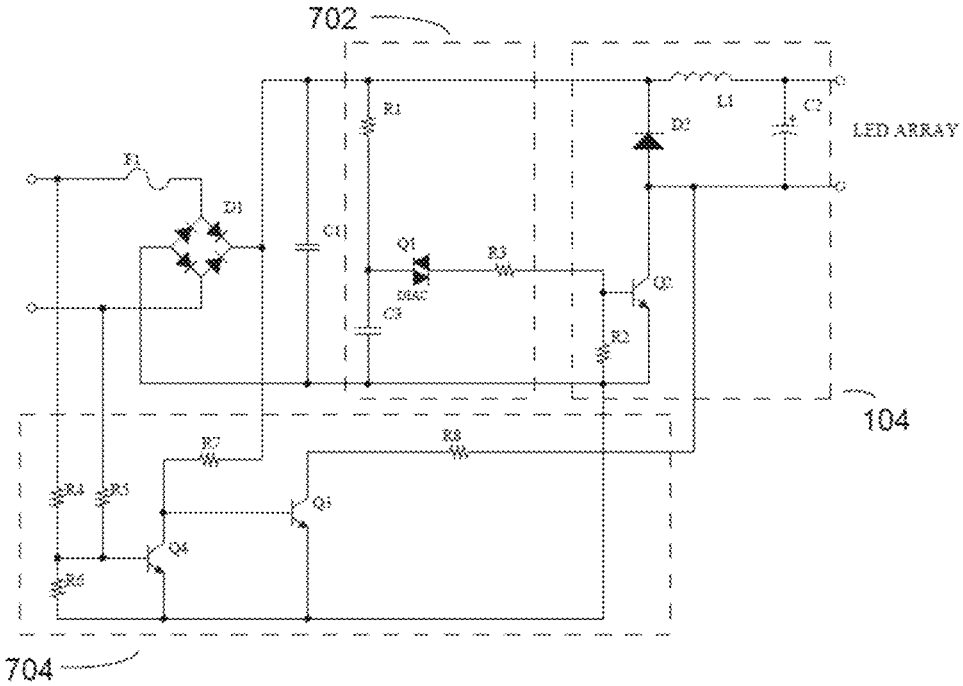
FIG. 7 is circuit diagram illustrating an LED driver with an exemplary zero crossing circuit to support a TRIAC dimmer.

A zero crossing circuit may be used in an LED driver to support low dimming levels with a TRIAC dimmer. The zero crossing circuit keeps the TRIAC dimmer on and stable at low current levels and prevents flicker. FIG. 7 illustrates an exemplary circuit design that includes a DIAC oscillator circuit 702, as well as the zero crossing circuit 704 that provides the minimum load needed by a TRIAC dimmer (not shown) near the zero crossing, i.e., low voltage portion. The zero crossing circuit includes transistors Q3 and Q4 and resistors R4, R5, R6, R7, and R8.

One terminal of R8 is connected to the LED array, the anode of diode D2 and the collector of transistor Q2. The other terminal of R8 is connected to the collector of transistor Q3. The collector of transistor Q3 is connected to R8, the base of transistor Q3 is connected to the collector of transistor Q4, and the emitter of transistor Q3 is connected to the emitter of transistor Q2, the emitter of transistor Q4, and resistor R6. The collector of transistor Q4 is connected to the base of transistor Q2 and to resistor R7, the base of transistor Q4 is connected to resistors R4, R5, and R6, and the emitter of transistor Q4 is connected to the emitter of transistor Q2, the emitter of transistor Q3, and resistor R6.

At low voltage levels, transistor Q4 does not clamp transistor Q3 so that it is on and current flows through the LED array and resistor R8. Once the voltage level increases above a threshold level, then transistor Q4 turns on and transistor Q3 turns off. The time when transistor Q3 is on is referred to herein as the linear operation region.

If the zero crossing circuit is combined with a DIAC oscillator circuit in an LED driver, then the LED driver alternates between linear operation and DIAC switched operation. The DIAC oscillator circuit does not necessarily operate during the linear operation because the voltage seen by the DIAC is below the DIAC breakover voltage. Referring to FIG. 2, DIAC switched operation occurs between points A and B and then again between points C and D and linear operation occurs between points B and C. The operation alternates between DIAC switched or switched operation and linear operation. However, there may be a short transition time during which both switching and linear operation occurs.

Although FIG. 7 illustrates the zero crossing circuit 704 combined with a DIAC oscillator circuit 702 and a buck circuit 104, the zero crossing circuit may be used with other types of circuits that control a switching circuit, including those that use an integrated circuit. If so, then instead of alternating between DIAC switched operation and linear operation, the LED driver alternates between switched operation and linear operation, where switched operation corresponds to the time when the timing device controls the switching circuit.

Figure 8:
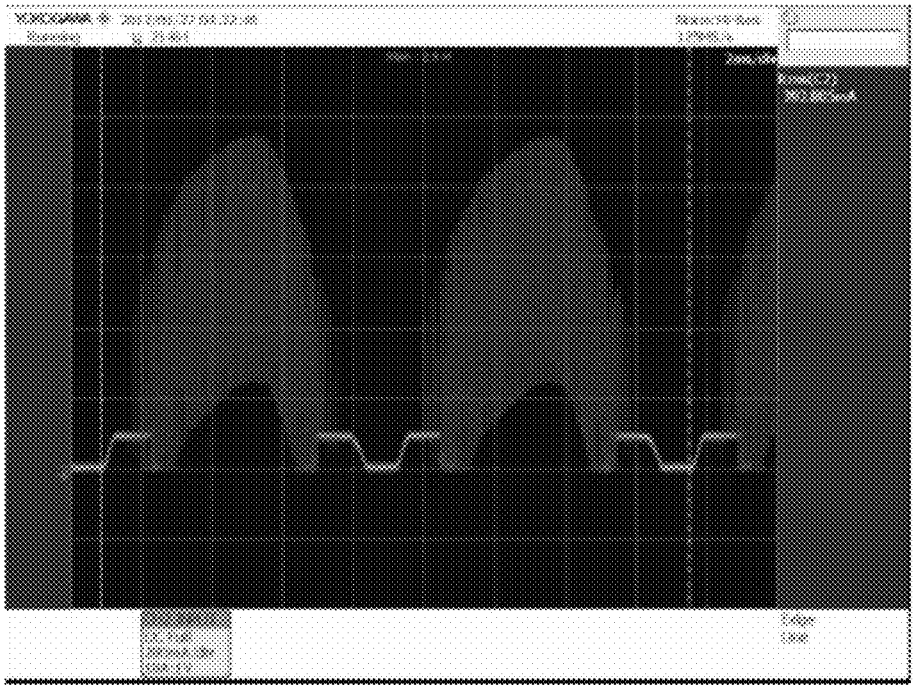
FIG. 8 is a waveform illustrating switched operation and constant current operation for another exemplary LED driver.

As an alternative to the zero crossing circuit illustrated by FIG. 7, resistor R8 may be replaced by a constant current circuit. The waveform of FIG. 8 illustrates the operation when resistor R8 is replaced by a constant current circuit. As shown in FIG. 8, the LED driver alternates between switched operation and constant current operation. The constant current operation is similar to the linear operation shown in FIG. 2, but the constant current circuit causes the current to rise/fall faster so that the constant current operation is longer than the linear operation.

Figure 9:
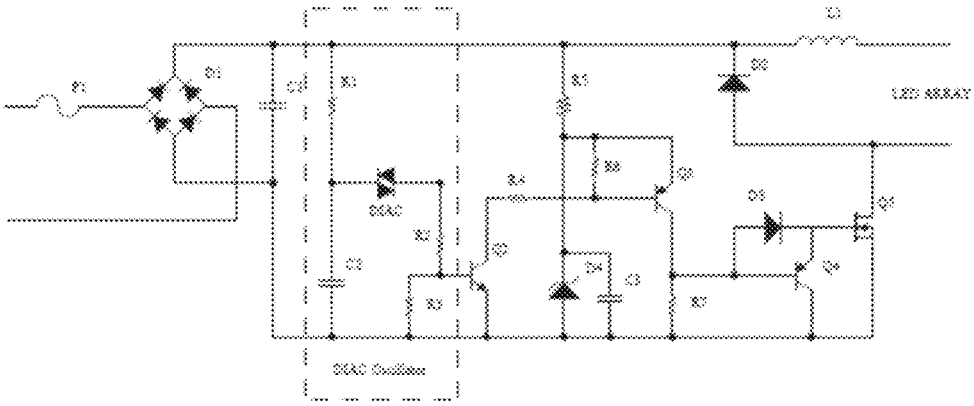
FIG. 9 is a circuit diagram illustrating an LED driver with a DIAC oscillator circuit and a switching circuit that uses a FET.
Figure 10:
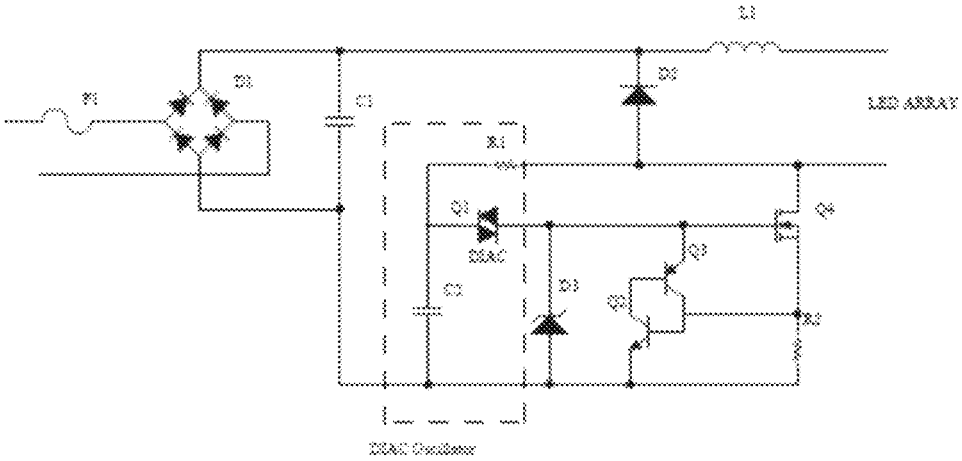
FIG. 10 is a circuit diagram illustrating another LED driver with a DIAC oscillator circuit and a switching circuit that uses a FET.
Figure 11:
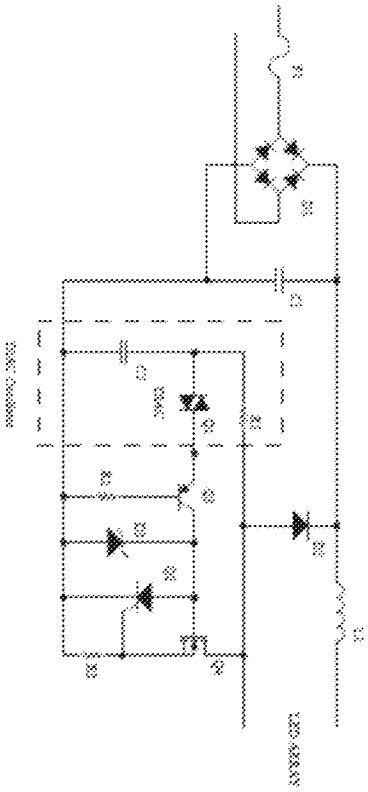
FIG. 11 is a circuit diagram illustrating another LED driver with a DIAC oscillator circuit and a switching circuit that uses a FET.

Although FIGS. 1, 5, 6 and 7 illustrate DIAC oscillator circuits controlling a switching circuit with bipolar transistors, a DIAC oscillator circuit may also control a switching circuit that uses FET transistors. FIGS. 9-11 illustrate exemplary switching circuit designs with FET transistors. In the FET implementations, there may be more components than in the bipolar implementations since the additional components are needed to provide sufficient voltage for the FETs. However, if a logic level FET is used, then the number of components may be reduced from the numbers shown in FIGS. 9-11.

Exemplary values for one implementation of FIG. 9 are as follows: R1=43K ohms, R2=33 ohms, R3=10K ohms, R4=100K ohms, R5=39K ohms, R6=10K ohms, R7=10K ohms, C1=0.1 uF, C2=0.01 uF, and C3=0.1 uF. Examplary values for one implementation of FIG. 10 are as follows: R1=88K ohms, R2=1 ohm, C1=0.1 uF, C2=0.01 uF. The circuit of FIG. 11 replaces the two transistors Q2 and Q3 of FIG. 10 with a silicon controlled rectifier (SCR) Q2 to improve turn-off Exemplary values for one implementation of FIG. 11 are as follows: R1=88K ohms, R2=10 ohms, R3=1 ohm, C1=0.1 uF, C2=0.01 uF.

The foregoing is provided for purposes of illustrating, explaining, and describing aspects of the present invention. Further modifications and adaptations to these examples will be apparent to those skilled in the art and may be made without departing from the scope or spirit of the invention. For example, although the embodiments described herein illustrate an LED array as the load, the circuit can be used with other types of loads that have similar power requirements. Different arrangements of the components depicted in the drawings or described above, as well as components not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. For example, although the foregoing examples illustrate the DIAC oscillator circuit connected to a buck circuit, the DIAC oscillator circuit can also be used to control a switch in other switch-mode circuit topologies, including flyback, boost, Cuk, and SEPIC circuits. Accordingly, the present invention is not limited to the embodiments described above or depicted in the drawings, and various embodiments and modifications can be made without departing from the scope of the invention.

I claim:

1. An LED driver comprising:

a DIAC oscillator circuit operable to be connected to a power source, comprising:

a DIAC, a first resistor, wherein a first terminal of the first resistor is connected to a first terminal of the DIAC and a capacitor and a second terminal of the first resistor is connected to a first connection point of a buck circuit, the capacitor, wherein a first terminal of the capacitor is connected to the first terminal of the DIAC and the first terminal of the first resistor and a second terminal of the capacitor is connected to a second connection point of the buck circuit; and a second resistor, wherein a first terminal of the second resistor is connected to a second terminal of the DIAC and a second terminal of the second resistor is connected to a third connection point of the buck circuit; and the buck circuit, wherein the buck circuit is operable to be connected to the power source and is operable to drive an LED array, and wherein the buck circuit includes a switch controlled by the DIAC oscillator.

2. The LED driver of claim 1, wherein the switch is a transistor and the first connection point of the buck circuit is connected to a collector of the transistor, the second connection point of the buck circuit is connected to an emitter of the transistor, and the third connection point of the buck circuit is connected to a base of the transistor.

3. The LED driver of claim 1, wherein the buck circuit includes a diode and the switch is a transistor, and wherein the first connection point of the buck circuit is connected to a cathode of the diode, the second connection point of the buck circuit is connected to an emitter of the transistor, and the third connection point of the buck circuit is connected to a base of the transistor.

4. The LED driver of claim 2, further comprising a turn off circuit, wherein the turn off circuit includes:

a third resistor, wherein a first terminal of the third resistor is connected to a first terminal of a second capacitor and a second terminal of the third resistor is connected to the first connection point of the buck circuit;

the second capacitor, wherein the first terminal of the second capacitor is connected to the first terminal of the third resistor and a second terminal of the second capacitor is connected to a base of a second transistor and a cathode of a second diode;

the second diode, wherein the cathode of the second diode is connected to the second terminal of the second capacitor and the base of the second transistor and an anode of the second diode is connected to the second connection point of the buck circuit, and an emitter of the second transistor; and the second transistor, wherein a collector of the second transistor is connected to the third connection point of the buck circuit and the second terminal of the first resistor, the base of the second transistor is connected to the second terminal of the second capacitor and the cathode of the second diode, and an emitter of the second transistor is connected to the second connection point of the buck circuit, and the anode of the second diode.

5. The LED driver of claim 3, further comprising a turn off circuit, wherein the turn off circuit includes:

a third resistor, wherein a first terminal of the third resistor is connected to a first terminal of a second capacitor and a second terminal of the third resistor is connected to a fourth connection point of the buck circuit;

the second capacitor, wherein the first terminal of the second capacitor is connected to the first terminal of the third resistor and a second terminal of the second capacitor is connected to a base of a second transistor and a cathode of a second diode;

the second diode, wherein the cathode of the second diode is connected to the second terminal of the second capacitor and the base of the second transistor, and an anode of the second diode is connected to the second connection point of the buck circuit, and an emitter of the second transistor; and the second transistor, wherein a collector of the second transistor is connected to the third connection point of the buck circuit and the second terminal of the discharge resistor, the base of the second transistor is connected to the second terminal of the second capacitor and the cathode of the second diode, and an emitter of the second transistor is connected to the second connection point of the buck circuit, and the anode of the second diode.

6. The LED driver of claim 5, wherein the buck circuit includes a diode and the switch is a transistor, and wherein the fourth connection point of the buck circuit is connected to an anode of the diode and the collector of the transistor.

7. The LED driver of claim 1, further comprising:

a zero crossing circuit, wherein the DIAC oscillator circuit turns the switch on and off during switched operation and turns the semiconductor switch off during linear operation and the zero crossing circuit provides a load to a TRIAC dimmer during linear operation.

8. The LED driver of claim 1, wherein the power source provides rectified line power.

9. An LED driver comprising:

a DIAC oscillator circuit operable to be connected to a power source, wherein the DIAC oscillator circuit includes a DIAC, a charging resistor, a capacitor, and a discharge resistor; and a switching circuit, wherein the switching circuit includes a semiconductor switch and an inductor, and the switching circuit is operable to be connected to an LED array, wherein the discharge resistor of the DIAC oscillator switch is connected to the semiconductor switch and the DIAC oscillator circuit controls the semiconductor switch so that when the DIAC is not conducting the semiconductor switch is off and the inductor is discharging and when the DIAC is conducting, the semiconductor switch is on and the inductor is charging.

10. The LED driver of claim 9, wherein the switching circuit is any one of the following: a buck circuit, a flyback circuit, a boost circuit, a Cuk circuit, or a SEPIC circuit.

11. The LED driver of claim 9, further comprising:

a turn off circuit connected to the semiconductor switch, wherein the turn off circuit operates to quickly turn off the semiconductor switch once it determines that the semiconductor switch is turning off.

12. The LED driver of claim 9, further comprising:

a zero crossing circuit, wherein the zero crossing circuit provides a load to a TRIAC dimmer at low current levels.

13. The LED driver of claim 12, wherein the DIAC oscillator turns the semiconductor switch on and off during switched operation and turns the semiconductor switch off during linear operation and the zero crossing circuit provides the load during linear operation.

14. The LED driver of claim 13, wherein the DIAC oscillator transitions between switched operation and linear operation, wherein a transition period from linear operation to switched operation occurs around a point when voltage to the timing circuit reaches a threshold level, and wherein a transition period from switched operation to linear operation occurs around a point when voltage to the timing circuit falls below the threshold level.

15. The LED driver of claim 9, wherein the power source provides rectified line power.

16. An LED driver, comprising:

a zero crossing circuit, wherein the zero crossing circuit provides a load to a TRIAC dimmer during linear operation, but not during switched operation;

a timing circuit for controlling a semiconductor switch in a switching circuit, wherein the timing circuit turns the semiconductor switch on and off during switched operation and turns the semiconductor switch off during linear operation; and the switching circuit, wherein the switching circuit stores energy when the semiconductor switch is on and discharges stored energy when the semiconductor switch is off and the switching circuit is operable to drive the LED array, wherein the LED driver transitions between linear operation and switched operation and between switched operation and linear operation, wherein a transition period from linear operation to switched operation occurs around a point when voltage to the timing circuit reaches a threshold level, and wherein a transition period from switched operation to linear operation occurs around a point when voltage to the timing circuit falls below the threshold level.

17. The LED driver of claim 16, wherein the zero crossing circuit includes a first switch and a second switch, and wherein the first switch switches the second switch on during linear operation and the first switch switches the second switch off during switched operation.

18. The LED driver of claim 16, wherein the load is provided by a resistor.

19. The LED driver of claim 16, wherein the load is provided by a constant current circuit.

20. The LED driver of claim 16, wherein the timing circuit is a DIAC oscillator circuit comprising:

a DIAC;

a charging resistor;

a capacitor connected to the diac and the charging resistor; and a discharge resistor connected to the DIAC and the semiconductor switch in the switching circuit, wherein the DIAC oscillator circuit controls the semiconductor switch so that when the DIAC is not conducting the semiconductor switch is off and the inductor is discharging and when the DIAC is conducting, the semiconductor switch is on and the inductor is charging.

21. The LED driver of claim 16, wherein the switching circuit is any one of the following: a buck circuit, a flyback circuit, a boost circuit, a Cuk circuit, or a SEPIC circuit.

* * * * *